US008528693B1

(12) United States Patent
Park

(10) Patent No.: US 8,528,693 B1
(45) Date of Patent: Sep. 10, 2013

(54) MUFFLER WITH DUAL EXHAUST GAS DISCHARGE PIPE FOR VEHICLE

(75) Inventor: Ki Chul Park, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 13/619,044

(22) Filed: Sep. 14, 2012

(30) Foreign Application Priority Data

Feb. 29, 2012 (KR) ..... 10-2012-0021077

(51) Int. Cl.

| | |
|---|---|
| ***F01N 1/24*** | (2006.01) |
| ***F01N 1/10*** | (2006.01) |
| ***F01N 1/08*** | (2006.01) |
| ***F01N 1/04*** | (2006.01) |

(52) U.S. Cl.
USPC ..... 181/268; 181/239; 181/264; 181/272

(58) Field of Classification Search
USPC ..... 181/237, 238, 239, 253, 254, 264, 181/265, 268, 272
See application file for complete search history.

(56) References Cited

U.S. PATENT DOCUMENTS

| | | | | |
|---|---|---|---|---|
| 5,025,890 | A * | 6/1991 | Hisashige et al. | 181/272 |
| 5,365,025 | A * | 11/1994 | Kraai et al. | 181/249 |
| 5,708,237 | A * | 1/1998 | Maeda et al. | 181/254 |
| 5,712,454 | A * | 1/1998 | Ozawa et al. | 181/226 |
| 5,739,483 | A * | 4/1998 | Yashiro et al. | 181/254 |
| 6,467,570 | B1 * | 10/2002 | Herold | 181/231 |
| 2002/0033302 | A1 * | 3/2002 | Kaneko et al. | 181/232 |

* cited by examiner

*Primary Examiner* — Jeremy Luks
(74) *Attorney, Agent, or Firm* — Morgan, Lewis & Bockius LLP

(57) ABSTRACT

A muffler apparatus for a vehicle may include a muffler housing that has first and fourth chambers formed at front and rear portions therein and second and third chambers formed between the first and fourth chambers in sequence, an exhaust gas intake pipe that may be inserted in the muffler housing through the front portion of the muffler housing, with an end portion thereof being disposed in the third chamber, and exhaust gas discharge pipes that may be connected with the second chamber and discharge an exhaust gas to the outside of the muffler housing.

7 Claims, 2 Drawing Sheets

MUFFLER WITH DUAL EXHAUST GAS DISCHARGE PIPE FOR VEHICLE

CROSS-REFERENCE TO RELATED APPLICATION

The present application claims priority to Korean Patent Application No. 10-2012-0021077, filed Feb. 29, 2012, the entire contents of which is incorporated herein for all purposes by this reference.

BACKGROUND OF THE INVENTION

1. Field of the Invention

The present disclosure relates to a muffler with a dual exhaust gas discharge pipe for a vehicle. More particularly, it relates to a muffler with a dual exhaust gas discharge pipe for a vehicle which makes it possible to increase the length of exhaust gas discharge pipes by disposing the exhaust gas discharge pipes at the front portion a muffler housing and to greatly reduce the surface area occupied by a hot section of the muffler housing.

2. Description of Related Art

A muffler of the related art, as shown in FIGS. 1 and 2, has a structure in which first, second, and third baffles 2, 3, 4 are fixed longitudinally in a muffler housing 1, the inside of the muffler housing 1 is divided into first, second, third, and fourth chambers 5, 6, 7, 8 by the first, second, and third baffles 2, 3, 4, and a plurality of air-through holes 2*a*, 3*a*, 4*a* are formed through the first, second, and third baffles 2, 3, 4 to connect adjacent chambers.

Further, an exhaust gas intake pipe 9 is disposed with the outlet end positioned in the second chamber 6 through the first chamber 5 and the first baffle 2 from the front of the muffler housing 1 and exhaust gas discharge pipes 10 are connected with the third chamber 7 and discharge an exhaust gas to the outside.

Further, the first chamber 5 and the fourth chamber 8 are filled with acoustic absorbents 11, 12 and the acoustic absorbents 11, 12 reduce exhaust noise and air flow-induced noise and particularly prevent heat transfer from the exhaust gas to the car body by absorbing high-temperature heat generated from the exhaust gas.

According to the structure of the muffler of the related art, however, the exhaust gas flowing into the third chamber 7 directly flows outside through the exhaust gas discharge pipes 10 before the exhaust noise is sufficiently absorbed by the acoustic absorbent 12 so that large air flow-induced noise of the exhaust gas is generated and it is difficult to reduce high-frequency noise of the exhaust gas with the acoustic absorbent 12 in the fourth chamber 8.

Further, since the exhaust gas discharge pipes 10 are connected to the third chamber 7 in the muffler of the related art, there is a limit in increasing the length of the exhaust gas discharge pipes 10 so that it is difficult to reduce booming noise of the exhaust gas.

Further, the whole area of the first and fourth chambers 5, 8 filled with the acoustic absorbents 11, 12 is about 20% to 30% of the entire area of the muffler housing 1, in the muffler of the related art so that adiabatic performance is poor.

That is, the whole area of the second and third chambers 6, 7, which are not filled with the acoustic absorbents 11, 12 is about 70% to 80% of the entire area of the muffler housing 1 and the second and third chambers 6, 7 are hot sections that discharge exhaust gas without absorbing the high-temperature heat, in the muffler of the related art so that a large amount of heat transfers to the car body (trunk room and rear bumper) adjacent to the muffler, and accordingly, large damage is generated by the exhaust gas.

The description provided above as a related art is just for helping understanding the background of the present invention and should not be construed as being included in the related art known by those skilled in the art.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a muffler with a dual exhaust gas discharge pipe for a vehicle which makes it possible to reduce air flow-induced noise and high-frequency noise of an exhaust gas without increasing back pressure of the exhaust gas by connecting exhaust gas discharge pipes with a second chamber, particularly to reduce booming noise of an exhaust gas by increasing the length of the exhaust gas discharge pipes, and further to considerably reduce damage to the car body due to heat from an exhaust gas by largely decreasing the surface area occupied by a hot section in the muffler.

In an aspect of the present invention, a muffler apparatus for a vehicle, may include a muffler housing that may have first and fourth chambers formed at front and rear portions therein and second and third chambers formed between the first and fourth chambers in sequence, an exhaust gas intake pipe that is inserted in the muffler housing through the front portion of the muffler housing, with an end portion thereof being disposed in the third chamber, and exhaust gas discharge pipes that are connected with the second chamber and discharge an exhaust gas to the outside of the muffler housing.

The muffler apparatus may further include acoustic absorbents that are filled in the first and fourth chambers, reduce exhaust noise, and absorb high-temperature heat of an exhaust gas.

First, second, and third baffles that divide the inside of the muffler housing into the first, second, third, and fourth chambers are fixed at predetermined distances in the front-rear direction in the muffler housing, and a plurality of air-through holes are formed through the first, second, and third baffles, respectively.

A plurality of holes connected with the second chamber to implement sporty sound quality due to an exhaust gas are formed at a portion of the exhaust gas intake pipe, which is positioned in the second chamber.

The acoustic absorbents are made of glass wool.

The area of the first and fourth chambers filled with the acoustic absorbents is 40% to 80% of the entire area of the muffler housing.

The exhaust gas discharge pipes are implemented with a dual pipe.

The air-through holes are uniformly disposed throughout the second baffle so that the exhaust gas in the third chamber is uniformly distributed and flows into the second chamber when flowing into the second chamber through the air-through holes of the second baffle and the exhaust gas flowing in the second chamber is uniformly divided into the exhaust gas discharge pipes and discharged outside.

Volume of the third chamber is smaller than volume of each of the second chamber and the fourth chamber.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
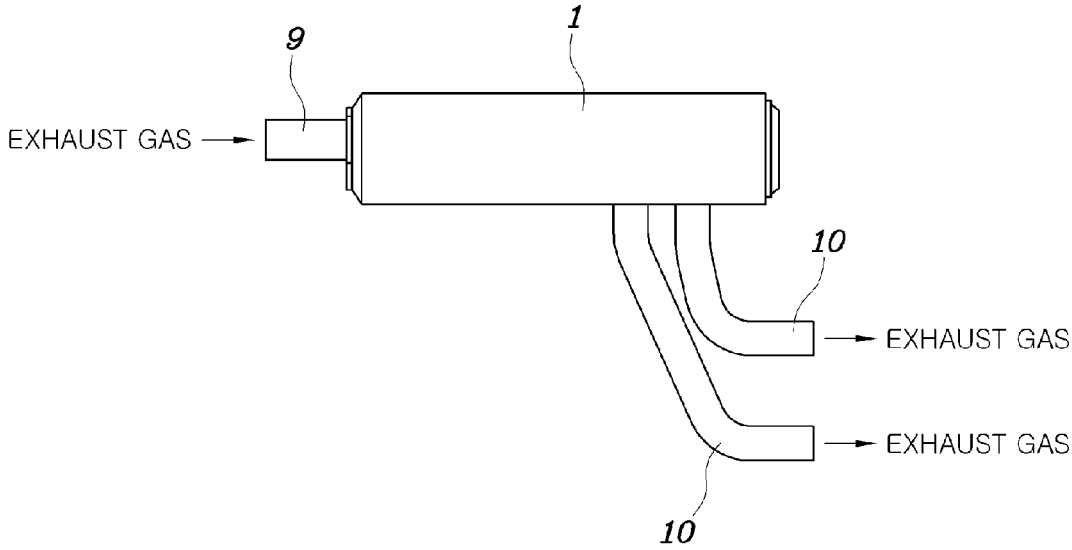
FIG. 1 (Related Art)
FIGS. 1 and 2 are a perspective view and cross-sectional views of a muffler of the related art, respectively.
Figure 2:
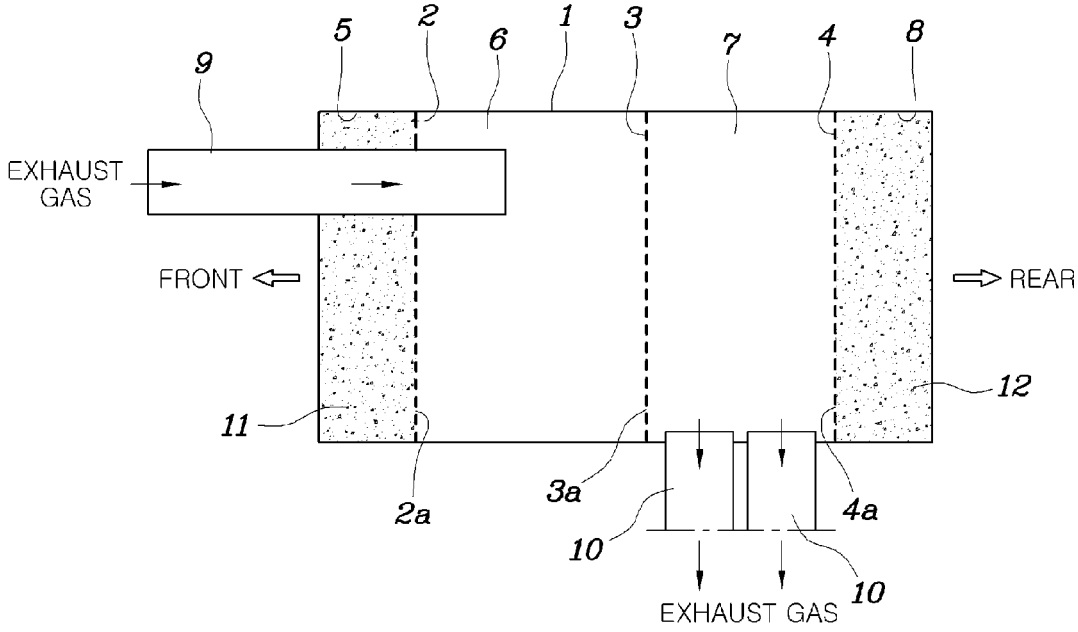
FIG. 2 (Related Art)

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter reference will now be made in detail to various embodiments of the present invention, examples of which are illustrated in the accompanying drawings and described below.

A muffler with a dual exhaust pipe for a vehicle according to an exemplary embodiment of the present invention is described hereafter with reference to the accompanying drawings.

Figure 3:
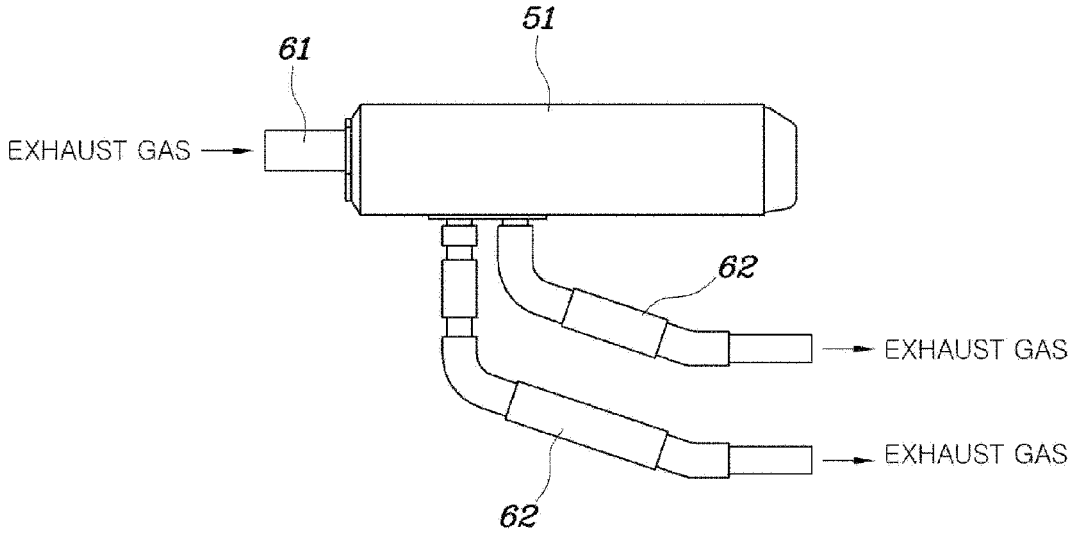
FIGS. 3 and 4 are a perspective view and a cross-sectional view of a muffler with a dual exhaust pipe for a vehicle according to an exemplary embodiment of the present invention, respectively.
Figure 4:
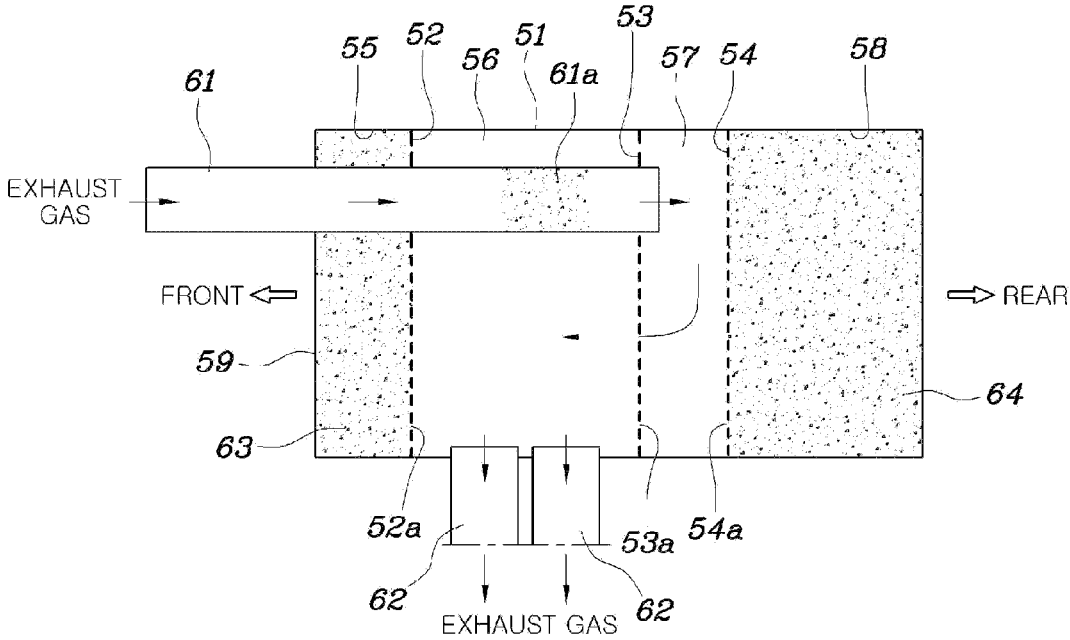

A muffler according to an exemplary embodiment of the present invention, as shown in FIGS. 3 and 4, includes a muffler housing 51 having a predetermined sealed space, and an exhaust gas intake pipe 61 and exhaust gas discharge pipes 62 that are disposed at the muffler housing 51.

That is, first, second, and third baffles 52, 53, 54 are fixed at predetermined distances in the front-rear direction in the muffler housing 51 such that the inside of the muffler housing 51 is divided into first, second, third, and fourth chambers 55, 56, 57, 58 by the first, second, and third baffles 52, 53, 54.

The first and fourth chambers 55, 58 are positioned at the front and rear ends in the muffler housing 51 and the second and third chambers 56, 57 are positioned therebetween.

A plurality of air-through holes 52*a*, 53*a*, 54*a* are integrally formed through the first, second, and third baffles 52, 53, 54, respectively.

The exhaust gas intake pipe 61 is inserted in the muffler housing 51 through the front portion 59 of the muffler housing 51, with the end disposed in the third chamber 57, and the exhaust gas discharge pipes 62 are connected with the second chamber 56 and discharge an exhaust gas to the outside of the muffler housing 51.

That is, the exhaust gas intake pipe 61 is inserted sequentially through the front portion 59, the first chamber 55, the first baffle 52, the second chamber 56, and the second baffle 53 of the muffler housing 51, with the end disposed in the third chamber 57.

On the other hand, a plurality of holes 61*a* connected with the second chamber 56 to implement sporty sound quality due to an exhaust gas are formed at the portion, which is positioned in the second chamber 56, in the exhaust gas intake pipe 61.

Further, the muffler according to an exemplary embodiment of the present invention further includes acoustic absorbents 63, 64 that are filled in the first and fourth chambers 55, 58, reduce exhaust noise, and absorb high-temperature heat of an exhaust gas.

The acoustic absorbents 63, 64 are made of glass wool but are not limited thereto.

Further, in the muffler according to an exemplary embodiment of the present invention, the area of the first and fourth chambers 55, 58 filled with the acoustic absorbents 63, 64 is 40% to 80% of the entire area of the muffler housing 51.

That is, the acoustic absorbents 63, 64 has high adiabatic performance so that the first and fourth chambers 55, 58 filled with the acoustic absorbents 63, 64 are cool sections in the muffler housing 51. On the contrary, the second and third chambers 56, 57 that are not filled with the acoustic absorbents 63, 64 are hot sections in the muffler housing 51 and the area of the hot sections is about 20% to 60% of the entire area of the muffler housing 51.

Since the area of the hot sections is about 20% to 60% of the entire area of the muffler housing 51 in the muffler according to an exemplary embodiment of the present invention and the area of the hot sections is about 70% to 80% of the entire muffler housing in mufflers of the related art, the muffler according to an exemplary embodiment of the present invention has the advantage of reducing damage to the car body due to heat from an exhaust gas by greatly reducing the area of the hot sections (second and third chambers) that transmits heat of the exhaust gas at a high temperature to the car body.

The area of the hot sections (second and third chambers) can be reduced by connecting the exhaust gas discharge pipes 62 to the second chamber 56, that is, it is possible to decrease the size of the third chamber 57 by connecting the discharge pipes 62 to the second chamber 56 and to increase the size of the fourth chamber 58 filled with the acoustic absorbent 64 as much as the decrease of the third chamber 57.

Therefore, as the size of the fourth chamber 58 filled with the acoustic absorbent 64 increases, the area of the second and third chambers 56, 57 that are the hot sections can be correspondingly decreased so that it is possible to reduce damage to the car body due to the heat of an exhaust gas at a high temperature.

Further, as the exhaust gas discharge pipes 62 are connected to the second chamber 56, in accordance with an exemplary embodiment of the present invention, it is possible to considerably elongate (increase the length of) the exhaust gas discharge pipes 62 so that it is possible to significantly reduce booming noise due to an exhaust gas that is discharged outside.

Meanwhile, the exhaust gas discharge pipes 62 are implemented with a dual pipe in the muffler according to an exemplary embodiment of the present invention so that a dynamic and powerful image and a refined image can strongly appeal to customers, and thus, it is possible to greatly improve the commercial value of a vehicle.

Therefore, when an exhaust gas flows into the third chamber 57 of the muffler housing 51 through the exhaust gas intake pipe 61, the exhaust noise is absorbed by the acoustic absorbent 64 in the fourth chamber 58 so that high-frequency noise and air flow-induced noise of the exhaust gas can be largely reduced.

Further, the exhaust gas flowing in the third chamber 57 hit to the third baffle 54 and is bounced to the second baffle 53 by pressure in the fourth chamber 58 and the exhaust gas turning to the second baffle 53 flows into the second chamber 56 through the air-through holes 53*a* of the second baffle 53 so that the air flow-induced noise can be largely reduced again in this process without increasing back pressure of the exhaust gas.

On the other hand, when the exhaust gas in the third chamber 57 flows into the second chamber 56 through the air-through holes 53*a* of the second baffle 53, the exhaust gas is uniformly distributed by the air-through holes 53*a*, which are uniformly disposed, and flow into the second chamber 56 so that the exhaust gas flowing in the second chamber 56 is uniformly divided into the two exhaust gas discharge pipes 62 and discharged outside.

Further, as the exhaust gas flows into the second chamber 56, the exhaust noise is absorbed by the acoustic absorbent 63 in the first chamber 55 so that the high-frequency noise and air flow-induced noise of the exhaust gas can be considerably reduced again.

Further, since the exhaust gas flowing in the second chamber 56 is discharged outside through the exhaust gas discharge pipes 62 and the exhaust gas discharge pipes 62 of the muffler according to an exemplary embodiment of the present invention are increased in length in comparison to the related art, it is possible to considerably reduce booming noise when the exhaust gas is discharged outside through the exhaust gas discharge pipes 62.

Further, since the first and fourth chambers 55, 58 filled with the acoustic absorbents 63, 64 are lager in area than the second and third chamber 56, 57 not filled with the acoustic absorbents 63, 64 in the muffler according to an exemplary embodiment of the present invention, it is possible to considerably reduce the area of the hot sections (second and third chambers) in the muffler housing 51 and it is correspondingly possible to largely reduce damage to the car body due to the heat of the exhaust gas at a high temperature.

Further, the exhaust gas discharge pipes 62 are implemented with a dual pipe in the muffler according to an exemplary embodiment of the present invention so that a dynamic and powerful image and a refined image can strongly appeal to customers, and thus, it is possible to greatly improve the commercial value of a vehicle.

According to an exemplary embodiment of the present invention, it is possible to reduce air flow-induced noise, and high-frequency noise and booming noise of the exhaust gas without increasing back pressure of the exhaust gas, and further to considerably reduce damage to the car body due to heat from an exhaust gas.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A muffler apparatus for a vehicle, comprising:

a muffler housing that has first and fourth chambers formed at front and rear portions therein and second and third chambers formed between the first and fourth chambers in sequence;

an exhaust gas intake pipe that is inserted in the muffler housing through the front portion of the muffler housing, with an end portion thereof being disposed in the third chamber; and exhaust gas discharge pipes that are connected with the second chamber and discharge an exhaust gas to the outside of the muffler housing;

wherein first, second, and third baffles that divide the inside of the muffler housing into the first, second, third, and fourth chambers are fixed at predetermined distances in the front-rear direction in the muffler housing;

wherein a plurality of air-through holes are formed through the first, second, and third baffles, respectively; and wherein the air-through holes are uniformly disposed throughout the second baffle so that the exhaust gas in the third chamber is uniformly distributed and flows into the second chamber when flowing into the second chamber through the air-through holes of the second baffle and the exhaust gas flowing in the second chamber is uniformly divided into the exhaust gas discharge pipes and discharged outside.

2. The muffler apparatus of claim 1, further including acoustic absorbents that are filled in the first and fourth chambers, reduce exhaust noise, and absorb high-temperature heat of an exhaust gas.

3. The muffler apparatus of claim 1, wherein a plurality of holes connected with the second chamber to implement sporty sound quality due to an exhaust gas are formed at a portion of the exhaust gas intake pipe, which is positioned in the second chamber.

4. The muffler apparatus of claim 2, wherein the acoustic absorbents are made of glass wool.

5. The muffler apparatus of claim 2, wherein the area of the first and fourth chambers filled with the acoustic absorbents is 40% to 80% of the entire area of the muffler housing.

6. The muffler apparatus of claim 1, wherein the exhaust gas discharge pipes are implemented with a dual pipe.

7. The muffler apparatus of claim 1, wherein the volume of the third chamber is smaller than the volume of each of the second chamber and the fourth chamber.

* * * * *